US006662780B2

(12) United States Patent
Yook

(10) Patent No.: US 6,662,780 B2
(45) Date of Patent: Dec. 16, 2003

(54) METHOD FOR CONTROLLING LIMP-HOME OF VEHICULAR ELECTRONIC THROTTLE SYSTEM

(75) Inventor: Chul-Soo Yook, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 101 days.

(21) Appl. No.: 10/040,752

(22) Filed: Dec. 28, 2001

(65) Prior Publication Data

US 2002/0083921 A1 Jul. 4, 2002

(30) Foreign Application Priority Data

Dec. 30, 2000 (KR) ..... 2000-86886

(51) Int. Cl.[7] ..... F02D 9/08
(52) U.S. Cl. ..... 123/336; 123/399
(58) Field of Search ..... 123/339.23, 336, 123/442, 399, 396, 403

(56) References Cited

U.S. PATENT DOCUMENTS 4,242,728 A 12/1980 Hartford
4,245,315 A 1/1981 Barman et al.
5,083,541 A * 1/1992 Chen ..... 123/339.17
5,366,424 A * 11/1994 Wataya ..... 477/107
5,417,625 A 5/1995 Yamaki et al.
5,524,589 A 6/1996 Kikkawa et al.
6,070,852 A 6/2000 McDonnell et al.
6,092,505 A * 7/2000 Takahashi et al. ..... 123/399
6,095,488 A 8/2000 Semeyn, Jr. et al.
6,155,533 A 12/2000 Semeyn et al.
6,209,518 B1 4/2001 Machida et al.

FOREIGN PATENT DOCUMENTS

WO WO01/29382 10/2000

* cited by examiner

*Primary Examiner*—Mahmoud Gimie
(74) *Attorney, Agent, or Firm*—Pennie & Edmonds LLP

(57) ABSTRACT

A method and system for controlling a limp-home function in an electronic throttle system adapted to prevent stalls which may occur due to failure of electronic throttle system by executing proper limp-home control to cater to a running state of the vehicle.

4 Claims, 2 Drawing Sheets

METHOD FOR CONTROLLING LIMP-HOME OF VEHICULAR ELECTRONIC THROTTLE SYSTEM

BACKGROUND OF THE INVENTION

The present invention relates to a system and method for controlling a limp-home function in an electronic throttle system, and more particularly, to a system and method for controlling the limp-home function adapted to prevent stalls by executing a proper limp-home control to cater to a running state of a vehicle when the electronic throttle system fails while the vehicle is in the running state.

In general, a throttle valve is linked to an acceleration pedal to adjust an output of an engine by controlling the amount of air to be drawn into a vehicle engine while the engine is running. When a driver manipulates an acceleration pedal, the open rate of the throttle valve correspondingly changes to control the quantity of air to be drawn into the engine.

Typically, the throttle valve is not connected to the acceleration pedal. Instead, based on signals generated by an Electronic Control Unit (ECU), the position of the throttle valve is determined through a throttle position sensor. The ECU calculates a target position of throttle valve to drive a driving motor and thus controls the throttle valve to obtain a target openness. The operational system thus described is called an electronic throttle system.

In general, a vehicle equipped with an electronic throttle system has a failure-safe function and a limp-home function. In the fail-safe function, the vehicle automatically performs safe running operations even if part of the system fails or malfunctions temporarily. In the limp-home function, a limp-home valve mounted on a throttle body is operated to take in a sufficient amount of air for temporary running of the engine so that the vehicle may run safely in spite of operational failure while the vehicle is running.

However, in conventional electronic throttle systems when there is a failure at the throttle valve position sensor. The output value of the sensor may be greatly changed, such that the electronic control system cannot perform a proper opening/closing of throttle valve, thereby leading to failure of engine.

SUMMARY OF THE INVENTION

The present invention provides a method for controlling the limp-home function in an electronic throttle system to prevent accidents that may occur due to unstable limp-home operation. Thus, a preferred method according to the present invention includes: detecting a malfunction of the throttle valve to determine whether the throttle valve has a problem of complete closure; determining whether a difference between a first output value set up as target by a throttle position sensor and a second output value measured by the throttle position sensor is greater than a first critical value and whether coolant temperature is larger than a reference value; determining whether an idle switch is turned on and whether engine revolution is less than a reference value; determining whether a reference period of time has lapsed and whether a third output value of the throttle position sensor has dropped below a second critical value and whether coolant temperature is higher than a reference value while the idle switch is turned on; and turning on a limp home valve if at least one of the conditions in the above steps is met.

Thus, according to a preferred embodiment of the present invention, if conditions provided at steps one through four are selectively determined and the limp-home valve is correspondingly controlled, it is possible for the limp-home valve to be properly controlled.

In a further preferred embodiment of the invention, a system is provided including an electronic control unit programmed to execute the above described steps.

BRIEF DESCRIPTION OF THE DRAWINGS

For fuller understanding of the nature and object of the invention, reference should be made to the following detailed description taken in conjunction with the accompanying drawings in which.

DETAILED DESCRIPTION OF THE INVENTION

Hereinafter, preferred embodiments of the present invention will be described in detail with reference to accompanying drawings.

Figure 1:
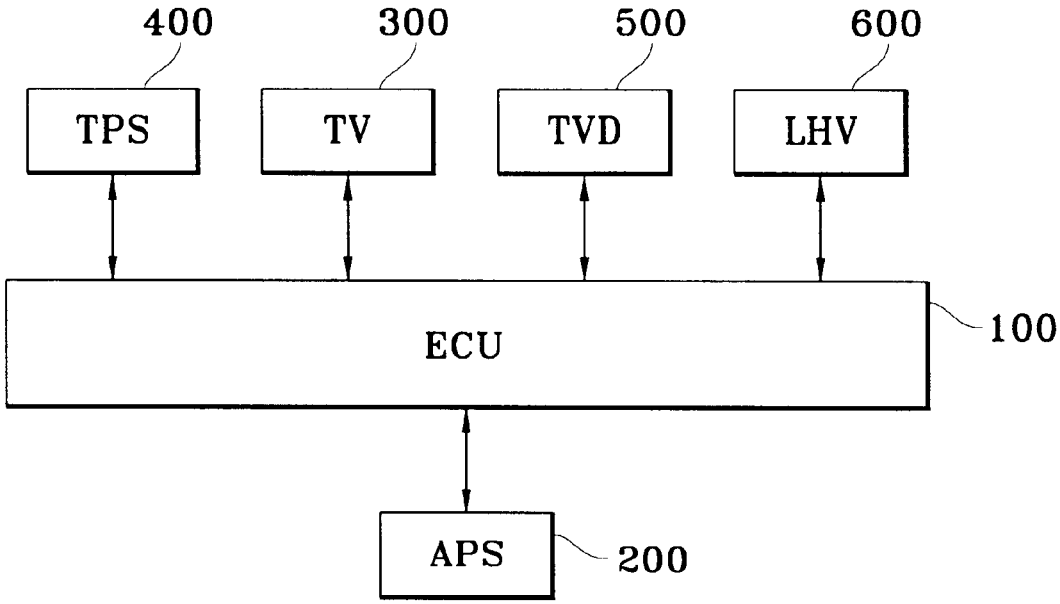
FIG. 1 is a schematic view illustrating a structure of an electronic throttle system in accordance with an embodiment of the present invention.

As shown in FIG. 1, the electronic throttle control system includes an electronic control unit (ECU) 100, an accelerator position sensor 200, a throttle valve 300, a throttle position sensor 400, a throttle valve drive part 500 and a limp-home valve 600. ECU 100 may include a processor programmed by a person of ordinary skill in the art to perform the control functions in accordance with the present invention as described herein.

The accelerator position sensor 200 outputs a signal corresponding to an accelerator position due to the driver's manipulation and transmits same to the electronic control unit 100. The electronic control unit 100 estimates a desired openness of the throttle valve 300 based on the signal output from the accelerator position sensor 200, transmits same to the throttle valve drive part 500 and detects the position of the throttle valve 300 based the signal transmitted from the throttle position sensor 400. The throttle valve drive part 500 opens or closes the throttle valve 300 based on the signal transmitted by the electronic control unit 100. If the output value transmitted from the throttle position sensor 400 varies over a predetermined level thereof to let the throttle valve abnormally and completely close or if the engine revolution falls under a reference value, the limp-home valve 600, mounted at the throttle body, is forcibly operated to take in a sufficient amount of air necessary for running the engine, thereby preventing the engine from stopping.

Figure 2:
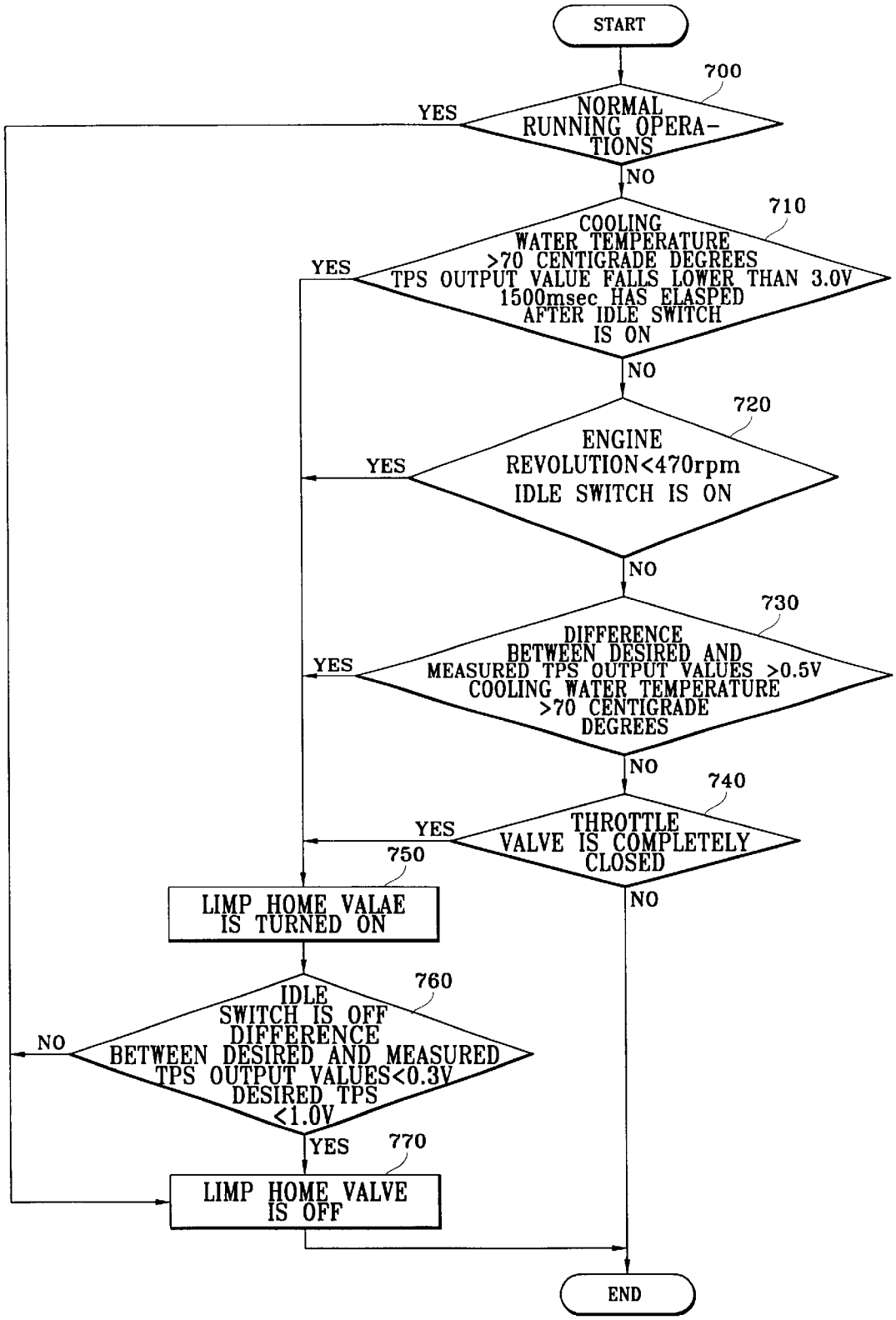
FIG. 2 is a flow chart illustrating a method for controlling a limp home of an electronic throttle system in accordance with an embodiment of the present invention.

A method for controlling the limp-home in an electronic throttle system will now be described in accordance with a preferred embodiment of the present invention. As shown in FIG. 2, the electronic control unit 100 first determines whether a vehicle is in normal running operation (S700). When the vehicle is not in its normal running state, the ECU 100 determines whether the temperature of the coolant is over 70 degrees centigrade, whether the output value of the throttle position sensor 400 falls more than 0.3V and whether 1.500 msec has elapsed after the engine idle switch (not shown) is turned on (S710). A coolant temperature signal may be obtained by ECU 100 from the cooling system thermostat (not shown).

If the above-said conditions are not met, a determination is made whether engine revolution is less than 470 rpm and the engine idle switch is turned on (S720).

Successively, if conditions of the previous step are not satisfied, a determination is made whether a difference between a desired and a measured output value of the throttle position sensor 400 is greater than 0.5V and whether a coolant temperature is greater than 70 degrees centigrade (S730).

Then, if conditions of the previous step are not satisfied, it is determined whether the throttle valve has a problem relating to its complete closure (S740).

As shown in FIG. 2, if any one of the conditions in steps S710 through S740 is met, the ECU forcibly operates the limp-home valve 600 to take in a sufficient amount of the air necessary for running the engine, thereby preventing the engine from stopping (S750).

Next, while the limp-home valve 600 is forcibly operated to prevent the engine from stopping, it is determined whether the idle switch is turned off, whether a difference between a desired and a measured output value of the throttle position sensor 400 is less than 0.3V and whether a target output value of the throttle valve 400 is less than 1.0V (S760). If these conditions are satisfied, the limp-home valve 600 is turned off (S770). On the other hand, if the vehicle is in normal running state (S700), the throttle valve 300 is normally operated to turn off the limp-home valve 600 (S770).

As described above, there are advantages in the method for controlling limp-home of vehicular electronic throttle system thus described according to the present invention in that, in case of failure in the contact of the throttle position sensor, a variety of conditions are selectively determined to accordingly cope with the limp home valve control, thereby preventing any accident that may be caused by instable operation of the limp home valve and to secure a running stability of a vehicle.

What is claimed is:

1. A method for controlling a limp-home function in a vehicular electronic throttle system, comprising:

detecting a malfunction of a throttle valve to determine whether the throttle valve has a problem of complete closure;

determining whether a difference between a first output value set up as target by a throttle position sensor and a second output value measured by the throttle position sensor is greater than a first critical value and whether coolant temperature is larger than a reference value;

determining whether an idle switch is turned on and whether engine revolution is less than a reference value;

determining whether a reference period of time has lapsed and whether a third output value of the throttle position sensor has dropped below a second critical value and whether coolant temperature is higher than a reference value while the idle switch is turned on; and turning on a limp-home valve if at least one of the conditions in the above steps is met.

2. The method as defined in claim 1, further comprising:

determining whether a difference between a fourth output value set up as target by the throttle position sensor and a fifth output value measured by the throttle position sensor is less than a third critical value and whether a sixth output value established by the throttle position sensor is smaller than a fourth critical value while the idle switch is turned off; and turning off the limp-home valve if the afore-said conditions are met.

3. A system for controlling a limp-home function in a vehicular electronic throttle system, comprising an accelerator position sensor, a throttle valve driven by a throttle valve driver, a throttle position sensor, and a limp-home valve, each communicating with an electronic control unit, wherein:

the electronic control unit is programmed to determine the presence of at least one of the following conditions based on said communication:

whether the throttle valve has a problem of complete closure;

whether a difference between a first output value set up as target by a throttle position sensor and a second output value measured by the throttle position sensor is greater than a first critical value and whether coolant temperature is larger than a reference value;

whether an idle switch is turned on and whether engine revolution is less than a reference value; and whether a reference period of time has lapsed and whether a third output value of the throttle position sensor has dropped below a second critical value and whether coolant temperature is higher than a reference value while the idle switch is turned on;

the electronic control unit turns on the limp-home valve if at least one of the conditions is met;

the electronic control unit is programmed to determine whether a difference between a fourth output value set up as target by the throttle position sensor and a fifth output value measured by the throttle position sensor is less than a third critical value and whether a sixth output value established by the throttle position sensor is smaller than a fourth critical value while the idle switch is turned off; and to turn off the limp-home valve if said further programmed conditions are met.

4. A system for controlling a limp-home function in a vehicular electronic throttle system, comprising an accelerator position sensor, a throttle valve driven by a throttle valve driver, a throttle position sensor, and a limp-home valve, each communicating with an electronic control unit, wherein:

the electronic control unit is programmed to determine the presence of at least one of the following conditions based on said communication:

whether a difference between a first output value set up as target by a throttle position sensor and a second output value measured by the throttle position sensor is greater than a first critical value and whether coolant temperature is larger than a reference value;

whether an idle switch is turned on and whether engine revolution is less than a reference value; and whether a reference period of time has lapsed and whether a third output value of the throttle position sensor has dropped below a second critical value and whether coolant temperature is higher than a reference value while the idle switch is turned on; and the electronic control unit turns on the limp-home valve if at least one of the conditions is met.

* * * * *